US010561955B1

(12) United States Patent
Renjie

(10) Patent No.: US 10,561,955 B1
(45) Date of Patent: Feb. 18, 2020

(54) TOY MADE OF PLUSH MATERIAL AND PLASTIC PARTS

(71) Applicant: NEW WISH, INC., Hanover, MD (US)

(72) Inventor: Wang Renjie, Hanover, MD (US)

(73) Assignee: NEW WISH, INC., Hanover, MD (US)

( * ) Notice: Subject to any disclaimer, the term of this patent is extended or adjusted under 35 U.S.C. 154(b) by 0 days.

(21) Appl. No.: 16/218,666

(22) Filed: Dec. 13, 2018

(51) Int. Cl.
*A63H 3/02* (2006.01)
*A63H 3/36* (2006.01)

(52) U.S. Cl.
CPC ..... *A63H 3/02* (2013.01); *A63H 3/36* (2013.01)

(58) Field of Classification Search
CPC . A63H 3/02; A63H 3/005; A63H 3/36; A63H 33/004; A63H 3/52; A63H 3/16; A63H 3/46; A63H 3/20; A63H 33/00; A63H 33/048
USPC ..... 446/71–73, 267, 268, 297, 327, 369; 206/457, 775
See application file for complete search history.

(56) References Cited

U.S. PATENT DOCUMENTS 2,096,872 A * 10/1937 Baker ..... G09F 23/14 229/116.3
2,532,729 A * 12/1950 Millstein ..... A63H 3/005 206/457
2,823,490 A * 2/1958 Griem ..... A63H 3/005 206/362.2
4,593,817 A * 6/1986 Ferrero ..... A45C 1/12 206/216
D320,632 S * 10/1991 Fortune ..... D21/617
5,072,843 A * 12/1991 James ..... A61J 9/0607 215/11.1
5,072,998 A * 12/1991 Oh ..... A63H 3/16 248/205.2
5,092,778 A * 3/1992 Shaver ..... A63F 9/0001 434/236
5,386,909 A * 2/1995 Spector ..... B65D 77/04 206/457
5,632,377 A * 5/1997 Ferrero ..... A23G 3/50 206/457
5,888,117 A * 3/1999 Sutton ..... A63H 3/003 40/410
6,186,852 B1 * 2/2001 Davis ..... A45C 1/12 446/73
6,644,497 B1 * 11/2003 Klundt ..... A63H 3/005 221/24
6,676,478 B1 * 1/2004 Starner ..... A63F 9/02 273/348.4
D554,432 S * 11/2007 Roth ..... D7/510
(Continued)

*Primary Examiner* — Nini F Legesse
(74) *Attorney, Agent, or Firm* — Epstein Drangel LLP; Robert L. Epstein

(57) ABSTRACT

The toy includes a first plush portion and a second plush portion connected by a rigid plastic part. The rigid part is at least partially hollow and includes a substantially cylindrical portion. The rigid part is permanently connected to one of the plush portions. It is detachably connected to the other of the plush portions. A connecting member permanently connects one of the plush portions to the rigid part. A second connecting member removeably connects the other plush portion to the rigid part. The toy may take the form of a creature such as be a bear. The first plush portion may include the head, arms and upper torso of the creature. The second plush portion may include the lower torso and legs of the creature.

3 Claims, 3 Drawing Sheets

(56) References Cited

U.S. PATENT DOCUMENTS

| | | | | |
|---|---|---|---|---|
| D684,730 | S * | 6/2013 | Grabois | D21/604 |
| 2006/0292956 | A1* | 12/2006 | Sayles | A45C 1/12<br>446/8 |
| 2008/0233829 | A1* | 9/2008 | Sayles | A45C 1/12<br>446/8 |
| 2011/0053452 | A1* | 3/2011 | Akkad | A63H 3/005<br>446/73 |
| 2012/0174871 | A1* | 7/2012 | Grabois | A01K 63/003<br>119/265 |
| 2013/0331000 | A1* | 12/2013 | Drozdowski | A63H 3/02<br>446/297 |

* cited by examiner

TOY MADE OF PLUSH MATERIAL AND PLASTIC PARTS

BACKGROUND OF THE INVENTION

1. Field of the Invention

The present invention relates to toys and more particularly to a toy made of a combination of plush material and plastic parts.

2. Description of Prior Art Including Information Disclosed Under 37 CFR 1.97 and 1.98

Toys made of plush material are well known. Toys made of plastic parts are also well known. However, toys made of a combination of plush material and plastic parts, particularly toys in the form of creatures such as a bear, are not known in the art.

As used in this specification, the term "plush" is meant to include any toy made of soft fabric and stuffed with cotton or a similar filling without limitation.

BRIEF SUMMARY OF THE INVENTION

It is a prime object of the present invention to provide a toy made of a combination of plush material and plastic parts.

That object is achieved by the present invention which relates to a toy including a first plush portion and a second plush portion connected by a rigid plastic part.

Preferably, the rigid plastic part is at least partially hollow and includes a substantially cylindrical portion.

The rigid plastic part is permanently connected to one of the plush portions. It is detachably connected to the other of the plush portions.

The toy includes a connecting member permanently connecting one of the plush portions to the rigid plastic part. The connecting member may be in the form of a ring.

The rigid plastic part has a threaded section. A threaded member is connected to one of the plush portions. The threaded section of the rigid plastic part engages the threaded member such that one of the plush portions is removeably connected to the rigid plastic part. The threaded member may be in the form of a ring.

The first plush portion may be the top of the toy. The second plush portion may be the bottom of the toy.

The toy may take the form of a creature. The creature may be a bear.

The first plush portion may include the head, arms and upper torso of the creature. The second plush portion may include the lower torso and legs of the creature.

BRIEF DESCRIPTION OF THE SEVERAL VIEWS OF DRAWINGS

To these and to such other objects that may hereinafter appear, the present invention relates to a toy made of plush material and plastic parts as described in detail in the following specification and recited in the annexed claims, taken together with the accompanying drawings, in which like numerals refer to like parts and in which:

DETAILED DESCRIPTION OF THE INVENTION

Figure 1:
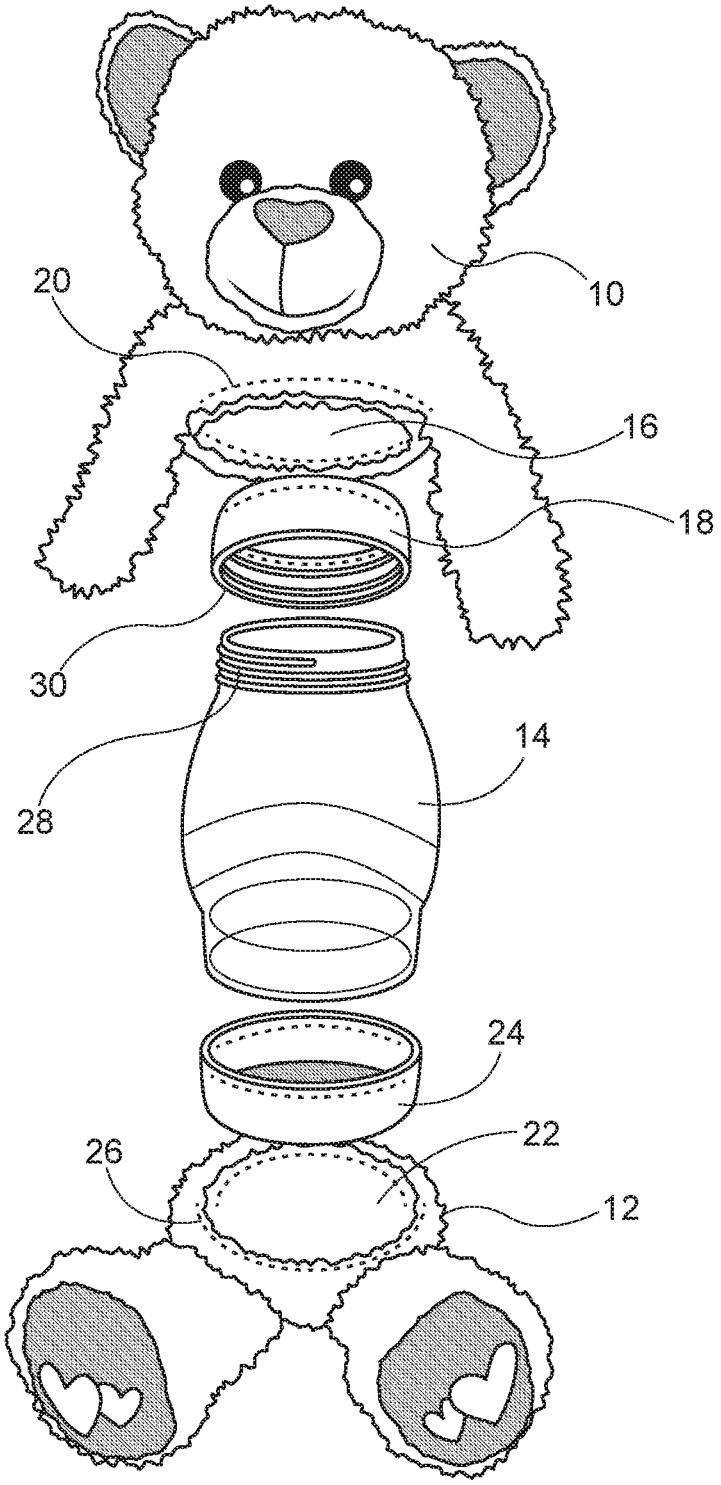
FIG. 1 is a fully exploded front elevation view of the toy of the present invention which in this preferred embodiment takes the form of a bear.

The above noted drawings illustrate a preferred embodiment of the present invention which takes the form of a creature such as a bear. These drawings are provided for purposes of explaining the construction of the toy of the present invention. It is to be understood that the present invention could take the form any type of plush toy which may include any creature or other configuration. Accordingly, the fact that the toy is depicted as a bear in the drawings is not to be considered a limitation on the scope of the present invention.

As seen in FIG. 1, the toy of the present invention includes an upper plush portion 10, a lower plush portion 12 and a rigid plastic part 14. Plastic part 14 connects the upper plush portion 10 and the lower plush portion 12. In the preferred embodiment illustrated in the figures, the upper plush portion 10 includes the head, arms and upper torso of the bear and the lower plush portion 12 includes the lower torso and legs of the bear.

The upper plush portion 10 has an opening 16 in the bottom surface thereof. A plastic connecting member or ring 18 is situated within opening 16 and is permanently fixed to plush part 10 within opening 16 by stitching along a stitch line 20 and by a layer of adhesive.

The lower plush portion 12 has an opening 22 in the top surface thereof. A second plastic connecting member or ring 24 is situated within opening 22 and is permanently fixed to lower plush portion 12 by stitching along a stitch line 26 and by a layer of adhesive.

Figure 2:
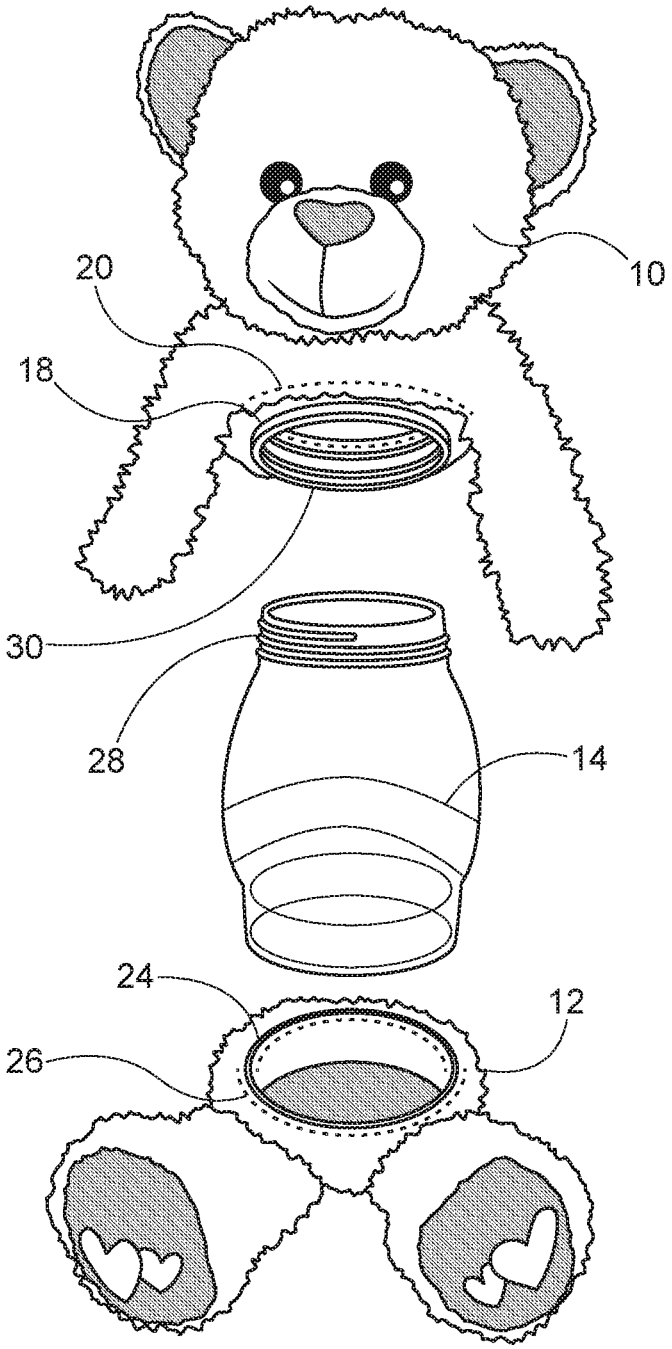
FIG. 2 is a partially exploded front elevation view of the toy of FIG. 1.

FIG. 2 shows the toy with connecting members 18 and 24 permanently attached to the upper plush portion 10 and the lower plush portion 12, respectively.

The exterior surface of the top portion of plastic part 14 is provided with a threaded section 28. The interior surface of connecting member 18 is provided with a threaded section 30. The threaded section 28 of plastic part 14 and the threaded section 30 of member 18 are configured to interengage such that the upper plush portion 10 can be removeably mounted on part 14 by rotating the upper plush portion 10 relative to plastic part 14.

The bottom of plastic part 14 is permanently attached to connecting member 24 by adhesive or any other conventional method. In this way, the lower plush portion 12 is permanently attached to the bottom of plastic part 14 through connecting member 24. Connecting member 24 may be made of plastic such that a durable connection can be formed between connecting member 24 and the bottom of plastic part 14.

Part 14 is formed of rigid plastic and may take the form of a hollow cylinder. The wall of part 14 is preferably formed of transparent or translucent rigid plastic.

As depicted in the preferred embodiment, the wall of part 14 has a central portion which has a somewhat larger diameter than the top or bottom of the part.

Figure 3:
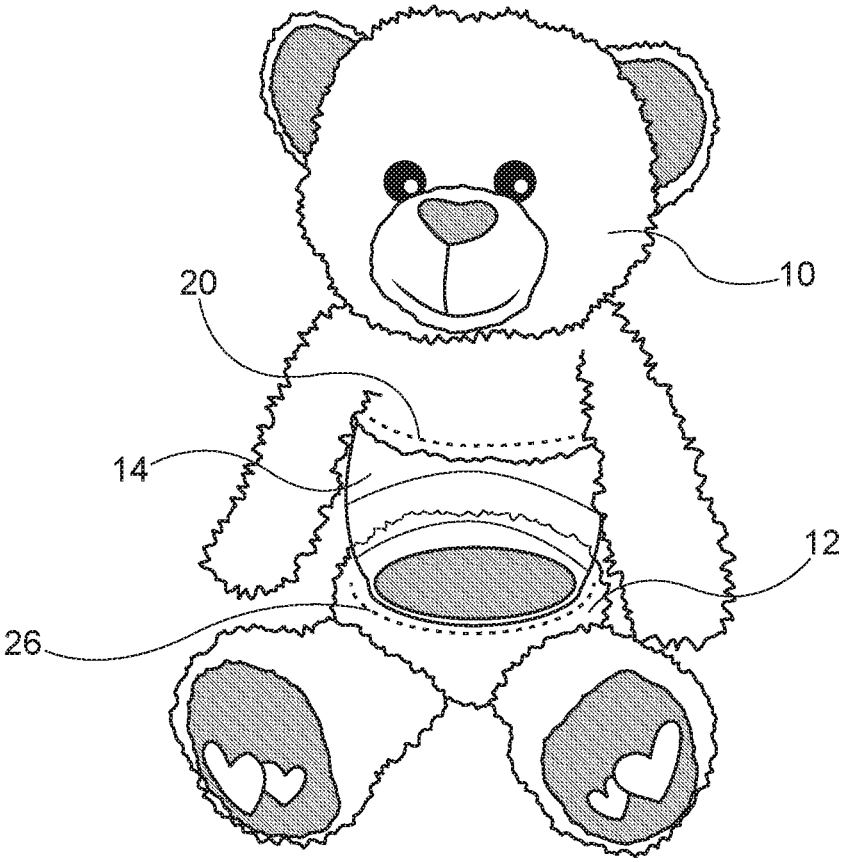
FIG. 3 is a front elevation view of the assembled toy.

FIG. 3 shows the fully assembled toy.

While only a single preferred embodiment of the present invention has been disclosed for purposes of illustration, it is obvious that many modifications and variations could be made thereto. It is intended to cover all of those modifications and variations which fall within the scope of the present invention, as defined by the following claims:

I claim:

1. A toy comprising a first plush part, a second plush part, a rigid plastic part having a first end and a second end, a first connecting ring and a second connecting ring, wherein said first connecting ring has an internally threaded portion and is permanently connected to said first plush part by a first stitch line, said second connecting ring is permanently connected to said second plush part by a second stitch line, said first end of said plastic part is externally threaded and adapted to engage said internally threaded portion of said first connecting ring and said second end of said plastic part is permanently connected to said second connecting ring.

2. The toy of claim 1 wherein said first connecting ring is connected to said plush part by stitches.

3. The toy of claim 1 wherein said second connecting ring is connected to said plush part by stitches.

* * * * *